US008936892B2

(12) United States Patent
Kaku et al.

(10) Patent No.: US 8,936,892 B2
(45) Date of Patent: Jan. 20, 2015

(54) ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

(75) Inventors: Kenichi Kaku, Newcastle Upon Tyne (GB); Wataru Kitamura, Numazu (JP); Mai Murakami, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 13/812,131

(22) PCT Filed: Jul. 20, 2011

(86) PCT No.: PCT/JP2011/067020

§ 371 (c)(1),
(2), (4) Date: Jan. 24, 2013

(87) PCT Pub. No.: WO2012/014909

PCT Pub. Date: Feb. 2, 2012

(65) Prior Publication Data

US 2013/0121727 A1 May 16, 2013

(30) Foreign Application Priority Data

Jul. 26, 2010 (JP) ..... 2010-167277

(51) Int. Cl.

| | |
|---|---|
| ***G03G 15/04*** | (2006.01) |
| ***G03G 5/04*** | (2006.01) |
| ***G03G 5/14*** | (2006.01) |

(52) U.S. Cl.

CPC ..... *G03G 5/04* (2013.01); *G03G 5/142* (2013.01); *G03G 5/144* (2013.01)

USPC ..... 430/60; 430/65; 399/111

(58) Field of Classification Search

CPC ..... G03G 5/144; G03G 5/04; G03G 5/142

USPC ..... 430/60, 65; 399/111

See application file for complete search history.

(56) References Cited

U.S. PATENT DOCUMENTS 1,020,504 A * 3/1912 Nertherlands ..... 414/692

FOREIGN PATENT DOCUMENTS

| | | | |
|---|---|---|---|
| CN | 001506756 | A | 6/2004 |
| CN | 001846175 | A | 10/2006 |
| CN | 101002147 | A | 7/2007 |
| CN | 101057282 | A | 10/2007 |
| CN | 101359132 | A | 2/2009 |
| CN | 101359177 | A | 2/2009 |

(Continued)

*Primary Examiner* — Thorl Chea

(74) *Attorney, Agent, or Firm* — Canon U.S.A. Inc., IP Division

(57) ABSTRACT

In order to provide an electrophotographic photosensitive member in which the dark-area potential does not easily change even when repeatedly used for a long period of time under a normal temperature/low humidity environment, a method of producing the electrophotographic photosensitive member, and a process cartridge and an electrophotographic apparatus, each comprising the electrophotographic photosensitive member, an undercoat layer of the electrophotographic photosensitive member is incorporated with an organic resin, a metal oxide particle, and a specific compound (phosphine oxide compound).

8 Claims, 1 Drawing Sheet

(56) References Cited

FOREIGN PATENT DOCUMENTS

| | | | |
|---|---|---|---|
| CN | 101360732 | A | 2/2009 |
| CN | 101361020 | A | 2/2009 |
| JP | 7-199510 | A | 8/1995 |
| JP | 2006-030700 | A | 2/2006 |
| JP | 2010-72018 | A | 4/2010 |

* cited by examiner

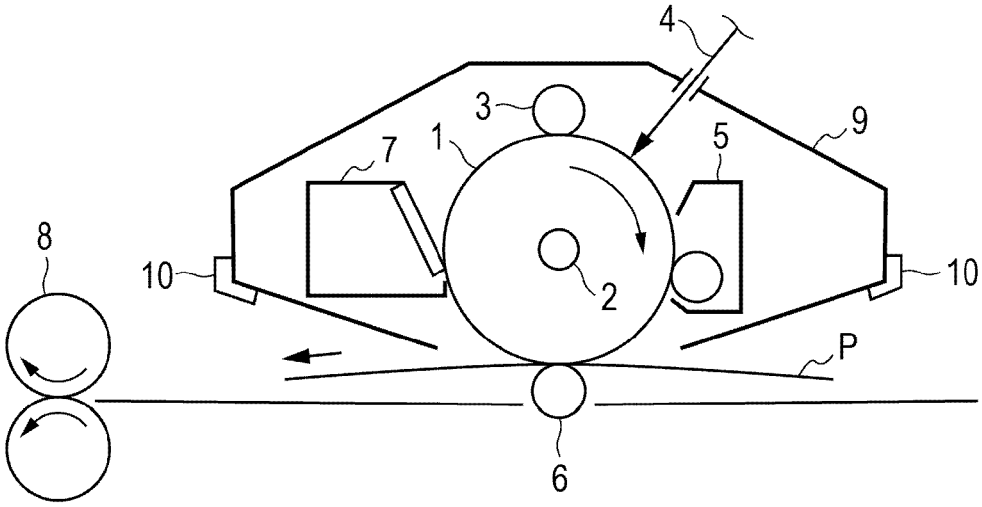
4
3
9
7
1
5
8
10
2
10
P
6

ELECTROPHOTOGRAPHIC PHOTOSENSITIVE MEMBER, METHOD OF PRODUCING ELECTROPHOTOGRAPHIC PHOTOSENSITIVE MEMBER, PROCESS CARTRIDGE, AND ELECTROPHOTOGRAPHIC APPARATUS

TECHNICAL FIELD

The present invention relates to an electrophotographic photosensitive member, a method of producing an electrophotographic photosensitive member, a process cartridge, and an electrophotographic apparatus.

BACKGROUND ART

In recent years, as electrophotographic photosensitive members used in electrophotographic apparatuses, electrophotographic photosensitive members (organic electrophotographic photosensitive members) having an undercoat layer which contains a metal oxide particle and a photosensitive layer which contains a charge-generating substance and a charge-transporting substance and which is formed on the undercoat layer have been used.

With recent enhancement of image quality and increases in the processing speed of electrophotographic apparatuses, one of the problems to be solved is to suppress variations in potential, i.e., changes in dark-area potential (charge potential) and the like, in electrophotographic photosensitive members when repeatedly used.

As a technique for suppressing variations in potential, there has been disclosed in PTL 1 a technique in which an undercoat layer of an electrophotographic photosensitive member is incorporated with a metal oxide particle to which an acceptor compound (organic compound) is added.

CITATION LIST

Patent Literature

PTL 1 Japanese Patent Laid-Open No. 2006-30700

SUMMARY OF INVENTION

Technical Problem

When the change in the contrast potential (i.e., the absolute value of the difference between dark-area potential and light-area potential) is large during repeated use over a long period of time, the toner developability changes, and the image density tends to change. In particular, when repeatedly used for a long period of time under a normal temperature/low humidity environment (e.g., 23° C./5% RH), charging of an electrophotographic photosensitive member by a charger becomes unstable, and the dark-area potential tends to change. As a result, the contrast potential changes, and the image density, in particular, tends to change.

The present invention provides an electrophotographic photosensitive member in which the dark-area potential does not easily change even when repeatedly used for a long period of time under a normal temperature/low humidity environment, a method of producing the electrophotographic photosensitive member, and a process cartridge and an electrophotographic apparatus, each including the electrophotographic photosensitive member.

Solution to Problem

According to the present invention, there is provided an electrophotographic photosensitive member comprising a support, an undercoat layer formed on the support, and a photosensitive layer formed on the undercoat layer, wherein the undercoat layer comprises an organic resin, a metal oxide particle, and a compound represented by the general formula (1) below.

[Chem. 1]

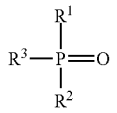

(1)

In general formula (1), $R^1$ to $R^3$ each independently represents an alkyl group having 1 to 8 carbon atoms, a phenyl group, or a tolyl group.

Furthermore, according to the present invention, there is provided a method of producing an electrophotographic photosensitive member comprising a support, an undercoat layer formed on the support, and a photosensitive layer formed on the undercoat layer, the method comprising a step of forming the undercoat layer using an undercoat layer coating liquid comprising an organic resin, a metal oxide particle, and a compound represented by the general formula (1) above.

Furthermore, according to the present invention, there is provided a process cartridge which integrally holds the electrophotographic photosensitive member and at least one unit selected from the group consisting of a charging unit, a developing unit, a transferring unit, and a cleaning unit, and which is detachably mountable to a main body of an electrophotographic apparatus.

Furthermore, according to the present invention, there is provided an electrophotographic apparatus comprising the electrophotographic photosensitive member, a charging unit, an exposing unit, a developing unit, and a transferring unit.

Advantageous Effects of Invention

According to the present invention, it is possible to provide an electrophotographic photosensitive member in which the dark-area potential does not easily change even when repeatedly used for a long period of time under a normal temperature/low humidity environment, a method of producing the electrophotographic photosensitive member, and a process cartridge and an electrophotographic apparatus, each including the electrophotographic photosensitive member.

BRIEF DESCRIPTION OF DRAWINGS

FIG. 1 is a view showing an example of a schematic structure of an electrophotographic apparatus provided with a process cartridge including an electrophotographic photosensitive member according to the present invention.

DESCRIPTION OF EMBODIMENTS

An electrophotographic photosensitive member according to the present invention includes a support, an undercoat layer formed on the support, and a photosensitive layer formed on the undercoat layer, in which the undercoat layer contains an organic resin, a metal oxide particle, and a compound represented by the general formula (1) below. The compound represented by the general formula (1) is a phosphine oxide compound.

[Chem. 2]

(1)

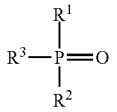

In general formula (1), $R^1$ to $R^3$ each independently represents an alkyl group having 1 to 8 carbon atoms, a phenyl group, or a tolyl group.

Examples of the alkyl group having 1 to 8 carbon atoms include a methyl group, an ethyl group, a propyl group, a butyl group, a pentyl group, a hexyl group, a heptyl group, and an octyl group. Examples of the tolyl group include an o-tolyl group, an m-tolyl group, and a p-tolyl group.

The present inventors presume as follows the reason why incorporation of the compound represented by the general formula (1) into the undercoat layer of the electrophotographic photosensitive member can suppress the change in dark-area potential when repeatedly used for a long period of time under a normal temperature/low humidity environment.

That is, the compound represented by the general formula (1) has a large dipole moment derived from the P═O group. For this reason, the present inventors presume that the compound represented by the general formula (1) interacts with the surface of the metal oxide particle in the undercoat layer to change the electron state on the surface of the metal oxide particle, thereby suppressing injection of holes from the support, and therefore, the change in dark-area potential can be suppressed.

Furthermore, the present inventors presume that at the time of the interaction, a positive charge is on P of the P═O group, a negative charge is on O of the P═O group, and the negative charge on O and the metal portion (oxygen-deficient portion) in the surface of the metal oxide particle interact with each other. The compound represented by the general formula (1) has a molecular structure in which O and three other functional groups ($R^1$ to $R^3$), with P at the center, assume a steric configuration similar to a tetrahedral configuration. Therefore, for example, in the case where each of $R^1$ to $R^3$ binds to P of P═O through an oxygen atom, in view of symmetry of the tetrahedral configuration, it is expected that the dipole moment of the P═O group is significantly decreased by the contribution of the other three —O—P bonds, which is undesirable. Consequently, it is necessary to select $R^1$ to $R^3$ in general formula (1) such that the dipole moment of the P═O group does not become too small. Specifically, it is necessary to select functional groups having low electron-releasing ability so that the positive charge on P becomes large. Furthermore, it is desirable to take into consideration ease of interaction with the organic resin. From these standpoints, in the present invention, $R^1$ to $R^3$ in general formula (1) each represent an alkyl group having 1 to 8 carbon atoms, a phenyl group, or a tolyl group, and can be an alkyl group having 2 to 6 carbon atoms.

Specific examples of the compound represented by the general formula (1) will be shown below. However, it is to be understood that the present invention is not limited thereto.

TABLE 1

| Exemplary compound | General formula (1) $R^1$ | $R^2$ | $R^3$ |
|---|---|---|---|
| (1-1) | $—CH_2CH_3$ | Same as left | Same as left |
| (1-2) | $—CH_2CH_2CH_2CH_3$ | Same as left | Same as left |
| (1-3) | $—CH_2CH(CH_3)_2$ | Same as left | Same as left |
| (1-4) | $—CH_2CH_2CH_2CH_2CH_3$ | Same as left | Same as left |
| (1-5) | $—CH_2CH_2CH(CH_3)_2$ | Same as left | Same as left |
| (1-6) | $—CH_2CH_2CH_2CH_2CH_2CH_3$ | Same as left | Same as left |
| (1-7) | $—CH_2CH_2CH_2CH_2CH_2CH_2CH_2CH_3$ | Same as left | Same as left |
| (1-8) | $—CH_2CH_3$ | $—CH_2CH_2CH_3$ | $—CH_2CH_2CH_2CH_3$ |
| (1-9) | 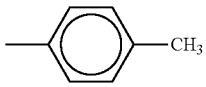 | Same as left | Same as left |
| (1-10) | $—CH_3$ | Same as left | Same as left |
| (1-11) | 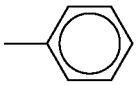 | Same as left | Same as left |

Among these compounds, exemplary compounds (1-1) to (1-8) are desirable, and in particular, exemplary compounds (1-1) and (1-6) are more desirable.

From the standpoint of further suppressing the change in dark-area potential, the content of the compound represented by the general formula (1) in the undercoat layer is preferably 0.1% to 20.0% by mass on the basis of the content of the metal oxide particle in the undercoat layer.

Furthermore, the ratio in content of the metal oxide particle to the organic resin in the undercoat layer, i.e., metal oxide particle/organic resin, is preferably 2/1 to 6/1 (ratio by mass). If the ratio by mass is 6/1 or less, cracks do not easily occur in the undercoat layer. If the ratio by mass is 2/1 or more, the distance between the metal oxide particle is shortened in the undercoat layer, ease of electron flow in the undercoat layer is increased, and therefore, the change in dark-area potential can be further suppressed.

Examples of a metal oxide of the metal oxide particle to be contained in the undercoat layer include a titanium oxide, a zinc oxide, a tin oxide, a zirconium oxide, and an aluminum oxide. Among them, from the standpoint of further suppressing the change in dark-area potential, a zinc oxide is desirable.

Furthermore, the surface of the metal oxide particle may be treated with a surface treatment agent, such as a silane coupling agent.

Examples of the organic resin to be contained in the undercoat layer include acrylic resins, allyl resins, alkyd resins, ethyl cellulose resins, ethylene-acrylic acid copolymers, epoxy resins, casein resins, silicone resins, gelatin resins, phenolic resins, butyral resins, polyacrylate, polyacetal, polyamideimide, polyamide, polyallyl ether, polyimide, polyurethane, polyester, polyethylene, polycarbonate, polystyrene, polysulfone, polyvinyl alcohol, polybutadiene, and polypropylene. Among them, from the standpoint of further suppressing the change in dark-area potential, polyamide and polyurethane are desirable, and in particular, polyurethane is more desirable.

As described above, an electrophotographic photosensitive member according to the present invention includes a support, an undercoat layer formed on the support, and a photosensitive layer formed on the undercoat layer.

The photosensitive layer may be a single-layer-type photosensitive layer containing a charge-transporting substance and a charge-generating substance in the same layer, or may be a lamination-type (separated-function-type) photosensitive layer in which a charge generation layer containing a charge-generating substance and a charge transport layer containing a charge-transporting substance are functionally separated. From the viewpoint of electrophotographic characteristics, a lamination-type photosensitive layer is desirable. Furthermore, the lamination-type photosensitive layer can be a photosensitive layer in which a charge generation layer and a charge transport layer are stacked in that order from the support side.

As the support, a support that exhibits conductivity (conductive support) can be used. For example, a support made of a metal (alloy), such as aluminum, an aluminum alloy, or stainless steel, can be used. The support may be, for example, cylindrical-shaped or belt-shaped. Desirably, the support is cylindrical-shaped.

The surface of the support may be subjected to cutting treatment, surface-roughening treatment, or alumite treatment for the purpose of suppressing interference fringes due to scattering of laser light, or the like.

A conductive layer may be provided between the support and the undercoat layer for the purpose of suppressing interference fringes due to scattering of laser light, covering flaws on the support, or the like.

The conductive layer can be formed by application of a conductive layer coating liquid obtained by subjecting a conductive particle, such as a carbon black, a metal particle, or a metal oxide particle, together with a binder resin and a solvent to dispersion treatment, followed by drying and/or curing.

The thickness of the conductive layer is preferably 5 to 40 μm, and more preferably 10 to 30 μm.

The undercoat layer is provided between the support or the conductive layer and the photosensitive layer (including the charge generation layer and the charge transport layer).

The undercoat layer can be formed by application of an undercoat layer coating liquid containing the organic resin, the metal oxide particle, and the compound represented by the general formula (1), followed by drying.

The content of the compound represented by the general formula (1) in the undercoat layer coating liquid is preferably 0.1% to 20.0% by mass on the basis of the content of the metal oxide particle in the undercoat layer coating liquid.

The undercoat layer coating liquid can be prepared by subjecting the metal oxide particle and the compound represented by the general formula (1) together with the organic resin and a solvent to dispersion treatment. Furthermore, the undercoat layer coating liquid can also be prepared by adding a solution in which the organic resin is dissolved to a dispersion liquid obtained by subjecting the metal oxide particle and the compound represented by the general formula (1) together with a solvent to dispersion treatment, and further performing dispersion treatment. Furthermore, the undercoat layer coating liquid can also be prepared by adding a solution in which the organic resin is dissolved to a mixture of the metal oxide particle and the compound represented by the general formula (1), and performing dispersion treatment. As the dispersion method, for example, a method using a homogenizer, an ultrasonic dispersion apparatus, a ball mill, a sand mill, a roll mill, a vibrating mill, an attritor, or a liquid impact type high-speed disperser may be mentioned.

Examples of the solvent that is used in the undercoat layer coating liquid include organic solvents, such as alcohols, sulfoxides, ketones, ethers, esters, aliphatic halogenated hydrocarbons, and aromatic compounds.

Furthermore, for the purpose of adjusting surface roughness of the undercoat layer or the like, an organic resin particle, such as a silicone particle, and a leveling agent, such as a silicone oil, may be further incorporated into the undercoat layer.

From the standpoint of further suppressing the change in dark-area potential, in the case where the conductive layer is provided, the thickness of the undercoat layer is preferably 0.5 to 10 μm, and more preferably 2 to 8 μm. In the case where the conductive layer is not provided, the thickness of the undercoat layer is preferably 10 to 30 μm, and more preferably 15 to 25 μm.

The photosensitive layer is provided on the undercoat layer.

Examples of the charge-generating substance include azo pigments, such as monoazo, disazo, and trisazo pigments; phthalocyanine pigments, such as metal phthalocyanine and nonmetal phthalocyanine; indigo pigments, such as indigo and thioindigo; perylene pigments, such as perylene acid anhydride and perylene acid imide; polycyclic quinone pigments, such as anthraquinone, pyrenequinone, and dibenzpyrenequinone; squalirium dyes; pyrylium salts and thiapyrylium salts; triphenylmethane pigments; quinacridone pigments; azulenium salt pigments; cyanine pigments, such as quinocyanine; anthanthrone pigments; pyranthrone pigments; xanthene dyes; quinoneimine dyes; and styryl dyes. These charge-generating substances may be used alone or in combination of two or more.

Among these charge-generating substances, from the viewpoint of sensitivity, phthalocyanine pigments and azo pigments are desirable, and in particular, phthalocyanine pigments are more desirable. Furthermore, among the phthalocyanine pigments, oxytitanium phthalocyanine, chlorogallium phthalocyanine, and hydroxygallium phthalocyanine are desirable, and in particular, hydroxygallium phthalocyanine is more desirable. Furthermore, regarding hydroxygallium phthalocyanine, hydroxygallium phthalocyanine crystals with a crystal form having strong peaks at Bragg angles 2θ of 7.4°±0.3° and 28.2°±0.3° in CuKα characteristic X-ray diffraction are desirable.

Furthermore, in the present invention, X-ray diffraction was measured using CuKα rays under the following conditions:

Measuring device used: automatic X-ray diffractometer MXP18 manufactured by MAC Science Co., Ltd.

X-ray tube: Cu

Tube voltage: 50 kV

Tube current: 300 mA

Scanning mode: 2θ/θ scanning
Scanning speed: 2 deg./min
Sampling spacing: 0.020 deg.
Start angle (2θ): 5 deg.
Stop angle (2θ): 40 deg.
Divergence slit: 0.5 deg.
Scattering slit: 0.5 deg.
Receiving slit: 0.3 deg.
Curved monochromator used In the case where the photosensitive layer is of lamination-type, examples of the binder resin that is used for the charge generation layer include acrylic resins, allyl resins, alkyd resins, epoxy resins, diallylphthalate resins, styrene-butadiene copolymers, butyral resins, benzal resins, polyacrylate, polyacetal, polyamideimide, polyamide, polyallyl ether, polyallylate, polyimide, polyurethane, polyester, polyethylene, polycarbonate, polystyrene, polysulfone, polyvinyl acetal, polybutadiene, polypropylene, methacrylic resins, urea resins, vinyl chloride-vinyl acetate copolymers, vinyl acetate resins, and vinyl chloride resins. Among them, butyral resins are desirable. These resins may be used alone or in combination of two or more as a mixture or a copolymer.

The charge generation layer can be formed by application of a charge generation layer coating liquid obtained by subjecting a charge-generating substance together with a binder resin and a solvent to dispersion treatment, followed by drying. As the dispersion method, for example, a method using a homogenizer, an ultrasonic dispersion apparatus, a ball mill, a sand mill, a roll mill, a vibrating mill, an attritor, or a liquid impact type high-speed disperser may be mentioned. The ratio in content of the charge-generating substance to the binder resin in the charge generation layer, i.e., charge-generating substance/binder resin, is preferably 0.3/1 to 10/1 (ratio by mass).

Examples of the solvent that is used in the charge generation layer coating liquid include organic solvents, such as alcohols, sulfoxides, ketones, ethers, esters, aliphatic halogenated hydrocarbons, and aromatic compounds.

The thickness of the charge generation layer is preferably 5 μm or less, and more preferably 0.1 to 2 μm.

Furthermore, as necessary, it is possible to add various types of sensitizers, antioxidants, ultraviolet absorbers, plasticizers, and the like to the charge generation layer.

Examples of the charge-transporting substance include hole-transporting compounds, such as triarylamine compounds, hydrazone compounds, styryl compounds, stilbene compounds, and butadiene compounds. These charge-transporting substances may be used alone or in combination of two or more. Among these charge-transporting substances, from the viewpoint of charge mobility, triarylamine compounds are desirable.

In the case where the photosensitive layer is of lamination-type, examples of the binder resin that is used for the charge transport layer include acrylic resins, acrylonitrile resins, allyl resins, alkyd resins, epoxy resins, silicone resins, phenolic resins, phenoxy resins, polyacrylamide, polyamideimide, polyamide, polyallyl ether, polyallylate, polyimide, polyurethane, polyester, polyethylene, polycarbonate, polysulfone, polyphenylene oxide, polybutadiene, polypropylene, and methacrylic resins. Among them, polyallylate and polycarbonate are desirable. These resins may be used alone or in combination of two or more as a mixture or a copolymer.

The charge transport layer can be formed by application of a charge transport layer coating liquid obtained by dissolving a charge-transporting substance and a binder resin in a solvent, followed by drying. The ratio in content of the charge-transporting substance and the binder resin in the charge transport layer, i.e., charge-transporting substance/binder resin, is preferably 0.3/1 to 10/1 (ratio by mass). From the standpoint of suppressing cracks of the charge transport layer, the drying temperature is preferably 60° C. to 150° C., and more preferably 80° C. to 120° C. Furthermore, the drying time is preferably 10 to 60 minutes.

Examples of the solvent that is used in the charge transport layer coating liquid include alcohols (in particular, alcohols having 3 or more carbon atoms), such as propanol and butanol; aromatic hydrocarbons, such as anisole, toluene, xylene, and chlorobenzene; and methylcyclohexane, ethylcyclohexane, and the like.

In the case where the charge transport layer is composed of a single layer, the thickness of the charge transport layer is preferably 5 to 40 μm, and more preferably 8 to 30 μm.

In the case where the charge transport layer has a laminated structure, the thickness of a charge transport layer on the support side is preferably 5 to 30 μm, and the thickness of a charge transport layer on the surface side is preferably 1 to 10 μm.

Furthermore, as necessary, it is possible to add an antioxidant, an ultraviolet absorber, a plasticizer, and the like to the charge transport layer.

Furthermore, in the present invention, for the purpose of improving durability, transferability, a cleaning property, or the like, a protective layer may be provided on the charge transport layer.

The protective layer can be formed by application of a protective layer coating liquid obtained by dissolving a resin in an organic solvent, followed by drying.

Examples of the resin that is used for the protective layer include polyvinyl butyral, polyester, polycarbonate, polyamide, polyimide, polyallylate, polyurethane, styrene-butadiene copolymers, styrene-acrylic acid copolymers, and styrene-acrylonitrile copolymers.

Furthermore, in order to enable the protective layer to also have charge transport ability, the protective layer may be formed by curing a monomer material having charge transport ability or a polymer-type charge-transporting substance using any of various crosslinking reactions. In particular, it is desirable to form a layer by curing by polymerization and/or crosslinking of a charge-transporting compound having a chain-polymerization functional group. Examples of the chain-polymerization functional group include an acryl group, an alkoxysilyl group, and an epoxy group. Examples of the curing reaction include radical polymerization, ionic polymerization, thermal polymerization, photopolymerization, radiation polymerization (electron radiation polymerization), plasma-enhanced CVD, and photo-assisted CVD.

Furthermore, as necessary, it is possible to add a conductive particle, an ultraviolet absorber, a wear-resistance improver, and the like to the protective layer. As a conductive particle, for example, a metal oxide particle, such as a tin oxide particle, is desirable. Examples of the wear-resistance improver include a fluorine atom-containing resin particle such as a polytetrafluoroethylene particle, an alumina particle, and a silica particle.

The thickness of the protective layer is preferably 0.5 to 20 μm, and more preferably 1 to 10 μm.

When the individual layer coating liquids are applied, for example, a dip application method (dip coating method), a spray coating method, a spinner coating method, a roller coating method, a Meyer bar coating method, a blade coating method, or the like can be used.

FIG. 1 shows a schematic structure of an electrophotographic apparatus provided with a process cartridge including an electrophotographic photosensitive member according to the present invention.

In FIG. 1, a cylindrical electrophotographic photosensitive member 1 of the present invention is rotated around an axis 2 in the direction indicated by an arrow at a predetermined peripheral speed (processing speed). While being rotated, the surface of the electrophotographic photosensitive member 1 is uniformly charged to a predetermined, positive or negative potential by a charging unit 3 (primary charging unit: for example, a charging roller or the like). Next, the surface receives exposure light 4 output from an exposing unit (not shown). Thus, an electrostatic latent image corresponding to the target image information is formed on the surface of the electrophotographic photosensitive member 1.

The electrostatic latent image formed on the surface of the electrophotographic photosensitive member 1 is developed with toner in a developing unit 5 (by a normal or reversal developing method) to be a toner image. Next, the toner image formed on the surface of the electrophotographic photosensitive member 1 is transferred onto a transfer medium P by a transferring bias from a transferring unit 6 (transfer roller or the like). In this process, the transfer medium P is fed from a transfer medium feeding unit (not shown) into a portion (contact portion) between the electrophotographic photosensitive member 1 and the transferring unit 6 in synchronization with the rotation of the electrophotographic photosensitive member 1. In addition, a bias voltage having a reverse polarity to the charge polarity of the toner is applied to the transferring unit 6.

The transfer medium P to which the toner image has been transferred is separated from the surface of the electrophotographic photosensitive member and conveyed to a fixing unit 8 where the toner image is subjected to a fixing process. Then, the transfer medium P is printed out as an image-formed product (print or copy) to the outside of the apparatus.

Adhering matter, such as the toner remaining after transfer (remaining toner untransferred), on the surface of the electrophotographic photosensitive member 1, from which the toner image has been transferred, is removed by a cleaning unit 7 (cleaning blade or the like) so that the surface is cleaned. In recent years, cleanerless systems have been researched, and it is also possible to collect the remaining toner untransferred by a developing machine or the like. Furthermore, the surface of the electrophotographic photosensitive member 1 is de-charged by pre-exposure light (not shown) from a pre-exposing unit (not shown), and is then repeatedly used for image formation. In addition, in the case where the charging unit 3 is a contact charging unit using a charging roller or the like, pre-exposure is not necessarily required.

In the present invention, a plurality of components selected from the electrophotographic photosensitive member 1, the charging unit 3, the developing unit 5, the cleaning unit 7, and the like may be held in a container and integrally combined together to constitute a process cartridge. Furthermore, the process cartridge may be configured so as to be detachably mountable to the main body of an electrophotographic apparatus, such as a copying machine or a laser beam printer. For example, at least one of the charging unit 3, the developing unit 5, and the cleaning unit 7 and the electrophotographic photosensitive member 1 can be integrally supported to constitute a cartridge, and cartridge can be used as a process cartridge 9 which is detachably mountable to the main body of an electrophotographic apparatus, using a guiding unit 10, such as a rail of the main body of the electrographic apparatus.

In the case where the electrophotographic apparatus is a copying machine or a printer, the exposure light 4 is reflected light or transmitted light from an original. Alternatively, the exposure light 4 is light irradiated by scanning with a laser beam according to signals into which an original read by a sensor is converted, or driving of an LED array or a liquid-crystal shutter array.

The electrophotographic photosensitive member of the present invention can be applied to electrophotographic apparatuses in general, such as electrophotographic copying machines, laser beam printers, LED printers, FAX machines, and liquid-crystal shutter printers. Furthermore, the electrophotographic photosensitive member of the present invention can be widely applied to devices, such as display, recording, near-print, plate making, and facsimile devices, which use electrophotographic techniques.

EXAMPLES

The present invention will be described in more detail below on the basis of specific examples. However, it is to be understood that the present invention is not limited thereto. In the examples, the term "part(s)" refers to "part(s) by mass".

Example 1

An aluminum cylinder which was a solid drawn tube with a diameter of 30 mm and a length of 357.5 mm was used as a support.

Next, 16 parts of a butyral resin (trade name: BM-1, manufactured by Sekisui Chemical Co., Ltd.) and 16 parts of blocked isocyanate (trade name: Sumidur 3175, manufactured by Sumitomo Bayer Urethane Co., Ltd.) as a curing agent were dissolved in 90 parts of methyl ethyl ketone to obtain a butyral resin solution. In the meantime, 50 parts of zinc oxide particles (trade name: MZ-500, average particle size: 30 nm, manufactured by Tayca Corporation) was mixed under stirring with 250 parts of toluene, and 1.5 parts of exemplary compound (1-1) as the compound represented by the general formula (1) was added thereto, followed by stirring for 5 hours. Then, toluene was removed by distillation under reduced pressure, and drying by heating under reduced pressure was performed at 140° C. for 3 hours. Thereby, a mixture of metal oxide particles and the compound represented by the general formula (1) was obtained. The resulting mixture (8.5 parts) together with 12.2 parts of the butyral resin solution and 8 parts of 1-butanol was placed in a paint shaker using 20 parts of glass beads with a diameter of 0.8 to 1 mm, and dispersion treatment was performed for 15 hours, to thereby obtain a dispersion liquid. By adding 0.2 parts of silicone resin particles (trade name: TOSPEARL 120, manufactured by GE Toshiba Silicone Co., Ltd.) and 0.001 parts of dioctyltin dilaurate as a catalyst to the resulting dispersion liquid, an undercoat layer coating liquid was prepared. The undercoat layer coating liquid was applied onto the support by dip coating, followed by drying at 160° C. for 40 minutes. Thereby, an undercoat layer with a thickness of 20 μm was formed.

Next, 4 parts of hydroxygallium phthalocyanine crystals with a crystal form having strong peaks at Bragg angles $2\theta \pm 0.2°$ of 7.4° and 28.1° in CuKα characteristic X-ray diffraction and 0.04 parts of a compound represented by structural formula (A) below were added to a resin solution obtained by dissolving 2 parts of polyvinyl butyral (trade name: S-LEC BX-1, manufactured by Sekisui Chemical Co., Ltd.) in 100 parts of cyclohexanone.

[Chem. 3]

(A)

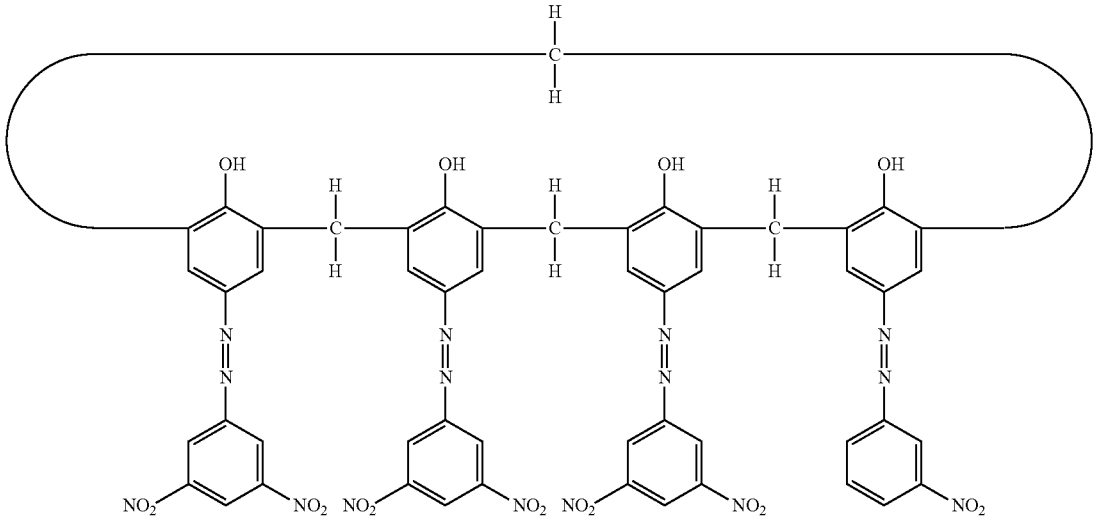

Then, the mixture was placed in a sand mill using glass beads with a diameter of 1 mm, and dispersion treatment was performed in an atmosphere of 23±3° C. for one hour. After the dispersion treatment, 100 parts of ethyl acetate was added to prepare a charge generation layer coating liquid. The charge generation layer coating liquid was applied onto the undercoat layer by dip coating, followed by drying at 90° C. for 10 minutes. Thereby, a charge generation layer with a thickness of 0.21 μm was formed.

Next, 50 parts of an amine compound (charge-transporting substance (hole-transporting compound)) represented by structural formula (B) below, 50 parts of an amine compound (charge-transporting substance (hole-transporting compound)) represented by structural formula (C) below, and 100 parts of polycarbonate (trade name: Iupilon 2400, manufactured by Mitsubishi Gas Chemical Company, Inc.) were dissolved in a mixed solvent including 650 parts of chlorobenzene and 150 parts of methylal(dimethoxymethane). Thereby, a charge transport layer coating liquid was prepared.

[Chem. 4]

(B)

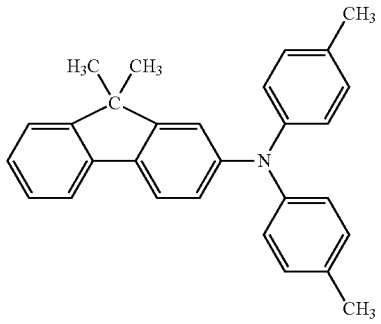

[Chem. 5]

(C)

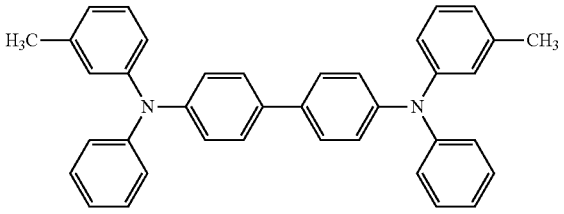

The charge transport layer coating liquid was left to stand for one day after becoming homogeneous. Then, the charge transport layer coating liquid was applied onto the charge generation layer by dip coating, followed by drying at 110° C. for 30 minutes. Thereby, a charge transport layer with a thickness of 18 μm was formed.

Next, 45 parts of a compound represented by structural formula (D) below and 55 parts of n-propanol were placed in an ultra-high pressure disperser, and dispersion treatment was performed to prepare a protective layer coating liquid (second charge transport layer coating liquid).

[Chem. 6]

(D)

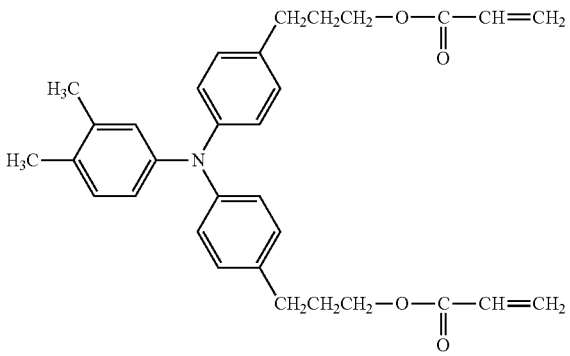

The protective layer coating liquid was applied onto the charge transport layer by dip coating, and the resulting coating film was dried at 50° C. for 5 minutes. After drying, electron beam irradiation was performed on the coating film under conditions of an accelerating voltage of 70 kV and an absorbed dose of 8,000 Gy. Subsequently, heat treatment was performed for 3 minutes such that the temperature of the coating film was 130° C. The oxygen concentration during electron beam irradiation and 3-minute heat treatment was 20 ppm. Next, heat treatment was performed in the air for 30 minutes such that the temperature of the coating film was 100° C. Thereby, a protective layer (second charge transport layer) with a thickness of 5 μm was formed.

In such a manner, an electrophotographic photosensitive member including the undercoat layer, the charge generation layer, the charge transport layer, and the protective layer (second charge transport layer) formed on the support was produced.

Examples 2 to 28

Electrophotographic photosensitive members were produced as in Example 1 except that the types and amounts of the compound represented by the general formula (1) and metal oxide particles used for preparing undercoat layer coating liquids were set as shown in Table 2. In Table 2, the titanium oxide particles are titanium oxide particles (trade name: TKP-101, crystallite diameter: 6 nm) manufactured by Tayca Corporation, the aluminum oxide particles are aluminum oxide particles (trade name: AKP-50) manufactured by Sumitomo Chemical Co., Ltd., and the tin oxide particles are tin oxide particles (trade name: CP056) manufactured by Tayca Corporation. Furthermore, in Table 2, the amounts of the compound represented by the general formula (1) and metal oxide particles are amounts used to obtain the mixture of metal oxide particles and the compound represented by the general formula (1).

TABLE 2

| | Compound represented by the general formula (1) | | Metal oxide particles | |
|---|---|---|---|---|
| | Type | Amount [part] | Type | Amount [part] |
| Example 1 | (1-1) | 50 | Zinc oxide particles | 1.5 |
| Example 2 | (1-2) | 50 | Zinc oxide particles | 1.5 |
| Example 3 | (1-3) | 50 | Zinc oxide particles | 1.5 |
| Example 4 | (1-4) | 50 | Zinc oxide particles | 1.5 |
| Example 5 | (1-5) | 50 | Zinc oxide particles | 1.5 |
| Example 6 | (1-6) | 50 | Zinc oxide particles | 1.5 |
| Example 7 | (1-7) | 50 | Zinc oxide particles | 1.5 |
| Example 8 | (1-8) | 50 | Zinc oxide particles | 1.5 |
| Example 9 | (1-9) | 50 | Zinc oxide particles | 1.5 |
| Example 10 | (1-1) | 50 | Titanium oxide particles | 1.5 |
| Example 11 | (1-2) | 50 | Titanium oxide particles | 1.5 |
| Example 12 | (1-6) | 50 | Titanium oxide particles | 1.5 |
| Example 13 | (1-7) | 50 | Titanium oxide particles | 1.5 |
| Example 14 | (1-1) | 50 | Aluminum oxide particles | 1.5 |
| Example 15 | (1-2) | 50 | Aluminum oxide particles | 1.5 |
| Example 16 | (1-6) | 50 | Aluminum oxide particles | 1.5 |
| Example 17 | (1-7) | 50 | Aluminum oxide particles | 1.5 |
| Example 18 | (1-1) | 50 | Tin oxide particles | 1.5 |
| Example 19 | (1-2) | 50 | Tin oxide particles | 1.5 |
| Example 20 | (1-6) | 50 | Tin oxide particles | 1.5 |
| Example 21 | (1-7) | 50 | Tin oxide particles | 1.5 |
| Example 22 | (1-1) | 50 | Zinc oxide particles | 0.025 |
| Example 23 | (1-1) | 50 | Zinc oxide particles | 0.05 |
| Example 24 | (1-1) | 50 | Zinc oxide particles | 0.5 |
| Example 25 | (1-1) | 50 | Zinc oxide particles | 2.5 |
| Example 26 | (1-1) | 50 | Zinc oxide particles | 5 |
| Example 27 | (1-1) | 50 | Zinc oxide particles | 10 |
| Example 28 | (1-1) | 50 | Zinc oxide particles | 12.5 |

Example 29

An aluminum cylinder which was a solid drawn tube with a diameter of 30 mm and a length of 357.5 mm was used as a support.

Next, 50 parts of titanium oxide particles coated with tin oxide containing 10% of antimony oxide, 25 parts of a resol-type phenolic resin, 20 parts of 1-methoxy-2-propanol, 5 parts of methanol, and 0.002 parts of silicone oil (polydimethylsiloxane-polyoxyalkylene copolymer, average molecular weight 3000) were placed in a sand mill using glass beads with a diameter of 0.8 mm, and dispersion treatment was performed for 2 hours to thereby obtain a dispersion liquid. By mixing 3.8 parts of silicone resin particles (trade name: TOSPEARL 120, manufactured by GE Toshiba Silicone Co., Ltd.) into the resulting dispersion liquid and stirring the mixture for 5 hours, a conductive layer coating liquid was prepared. The conductive layer coating liquid was applied onto the support by dip coating, followed by drying at 140° C. for 30 minutes. Thereby, a conductive layer with a thickness of 20 μm was formed.

Next, by dissolving 10 parts of N-methoxymethylated 6 nylon (trade name: Toresin EF-30T, manufactured by Nagase chemteX Corporation, methoxymethylation ratio: 28% to 33% by mass) in 90 parts of methanol, a nylon resin solution was obtained. In the meantime, 50 parts of zinc oxide particles (trade name: MZ-500, average particle size: 30 nm, manufactured by Tayca Corporation) was mixed under stirring with 250 parts of toluene, and 1.5 parts of exemplary compound (1-1) as the compound represented by the general formula (1) was added thereto, followed by stirring for 5 hours. Then, toluene was removed by distillation under reduced pressure, and drying by heating under reduced pressure was performed at 140° C. for 3 hours. Thereby, a mixture of metal oxide particles and the compound represented by the general formula (1) was obtained. The resulting mixture (8.5 part‘s) together with 15 parts of the nylon resin solution was placed in a paint shaker using 20 parts of glass beads with a diameter of 0.8 to 1 mm, and dispersion treatment was performed for 15 hours. Thereby, an undercoat layer coating liquid was prepared. The undercoat layer coating liquid was applied onto the conductive layer by dip coating, followed by drying at 100° C. for 15 minutes. Thereby, an undercoat layer with a thickness of 2 μm was formed.

A charge generation layer, a charge transport layer, and a protective layer (second charge transport layer) were formed on the undercoat layer as in Example 1. In such a manner, an electrophotographic photosensitive member including the conductive layer, the undercoat layer, the charge generation layer, the charge transport layer, and the protective layer (second charge transport layer) formed on the support was produced.

Example 30

An electrophotographic photosensitive member was produced as in Example 29 except that exemplary compound (1-1) used for the preparation of the undercoat layer coating liquid was changed to exemplary compound (1-2).

Comparative Example 1

An electrophotographic photosensitive member was produced as in Example 1 except that exemplary compound (1-1) was not used when the undercoat layer coating liquid was prepared.

Comparative Example 2

An electrophotographic photosensitive member was produced as in Example 1 except that exemplary compound (1-1) used for the preparation of the undercoat layer coating liquid was changed to a silane coupling agent (trade name: KBM603, manufactured by Shin-Etsu Chemical Co., Ltd).

Comparative Example 3

An electrophotographic photosensitive member was produced as in Example 1 except that exemplary compound (1-1)

used for the preparation of the undercoat layer coating liquid was changed to triethoxyphosphine oxide ($(C_2H_5O)_3P{=}O$).

Evaluation of Dark-Area Potential when Repeatedly Used

As an evaluation apparatus, a copying machine (trade name: GP405) manufactured by CANON KABUSHIKI KAISHA was used (modified to a processing speed of 300 mm/sec; charging unit: roller-type contact charging member (charging roller) to which a voltage obtained by superposing an AC voltage on a DC voltage was applied; exposing unit: laser image exposure system (wavelength 780 nm); developing unit: one-component magnetic negative toner non-contact development system; transferring unit: roller-type contact transferring system; cleaning unit: blade cleaning system having a rubber blade set in the counter direction; pre-exposing unit: fuse lamp). The electrophotographic photosensitive members of Examples 1 to 30 and Comparative Examples 1 to 3 were each set in the evaluation apparatus.

The evaluation apparatus was installed under a normal temperature/low humidity environment of 23° C./5% RH. The charging conditions were as follows: peak to peak voltage of AC component applied to the charging roller: 1,500 V, frequency of AC component: 1,500 Hz, and DC component: −850 V. Furthermore, the exposure conditions were adjusted such that, in the case of laser exposure light irradiation, the initial light-area potential (Vla) before the long endurance test was −200 V in each of the electrophotographic photosensitive members.

The surface potential of the electrophotographic photosensitive member was measured by removing the development cartridge from the evaluation apparatus and inserting a potential measurement device into the space from which the development cartridge was removed. The potential measurement device was configured to locate a potential measurement probe at the development position of the development cartridge. The potential measurement probe was positioned at the center in the axial direction of the electrophotographic photosensitive member, and the gap from the surface of the electrophotographic photosensitive member was 3 mm.

Next, evaluation was performed according to the procedure described below. Note that, in each of the electrophotographic photosensitive members, the evaluation was performed under the initially set charging conditions and exposure conditions. Furthermore, for the purpose of adaptation to the normal temperature/low humidity environment of 23° C./5% RH, each of the electrophotographic photosensitive members was left to stand under the same environment for 72 hours, and then the evaluation was performed.

The development cartridge having the electrophotographic photosensitive member mounted therein was fitted in the evaluation apparatus, and a long endurance test was carried out by passing 50,000 sheets. After the long endurance test was completed, the evaluation apparatus was left to stand for 5 minutes. Then, the development cartridge was replaced with the potential measurement device, and the dark-area potential (Vdb) and the light-area potential (Vlb) after the long endurance test were measured. The amount of change in dark-area potential before and after the long endurance test ($\Delta Vd = |Vdb| - |Vda|$) and the amount of change in light-area potential before and after the long endurance test ($\Delta Vl = |Vlb| - |Vla|$) were calculated. In the above expressions, Vda represents the initial dark-area potential before the long endurance test, Vla represents the initial light-area potential before the long endurance test, and |Vdb|, |Vda|, |Vlb|, and |Vla| respectively represent absolute values of Vdb, Vda, Vlb, and Vla. The evaluation results are shown in Table 3.

TABLE 3

| | ΔVd [V] | ΔVl [V] |
|---|---|---|
| Example 1 | −5 | 10 |
| Example 2 | −5 | 10 |
| Example 3 | −5 | 10 |
| Example 4 | −5 | 11 |
| Example 5 | −5 | 10 |
| Example 6 | −5 | 10 |
| Example 7 | −7 | 12 |
| Example 8 | −5 | 10 |
| Example 9 | −7 | 11 |
| Example 10 | −9 | 11 |
| Example 11 | −9 | 12 |
| Example 12 | −9 | 12 |
| Example 13 | −12 | 11 |
| Example 14 | −8 | 15 |
| Example 15 | −8 | 15 |
| Example 16 | −8 | 15 |
| Example 17 | −11 | 15 |
| Example 18 | −7 | 8 |
| Example 19 | −7 | 9 |
| Example 20 | −7 | 9 |
| Example 21 | −10 | 8 |
| Example 22 | −10 | 8 |
| Example 23 | −7 | 8 |
| Example 24 | −5 | 9 |
| Example 25 | −5 | 11 |
| Example 26 | −5 | 11 |
| Example 27 | −6 | 12 |
| Example 28 | −10 | 10 |
| Example 29 | −5 | 10 |
| Example 30 | −5 | 10 |
| Comparative Example 1 | −45 | −22 |
| Comparative Example 2 | −25 | 15 |
| Comparative Example 3 | −35 | −20 |

As is evident from the results, by incorporating the organic resin, the metal oxide particle, and the compound represented by the general formula (1) above into the undercoat layer, it is possible to suppress the change in dark-area potential even when repeatedly used for a long period of time under a normal temperature/low humidity environment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-167277, filed Jul. 26, 2010, which is hereby incorporated by reference herein in its entirety.

The invention claimed is:

1. An electrophotographic photosensitive member comprising:

a conductive support;

an undercoat layer formed on the conductive support; and a photosensitive layer formed on the undercoat layer, wherein the undercoat layer comprises an organic resin, a metal oxide particle, and a compound represented by the general formula (1) below:

[Chem. 1]

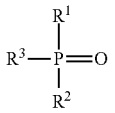

(1)

wherein, in the general formula (1), $R^1$ to $R^3$ each independently represents an alkyl group having 1 to 8 carbon atoms, a phenyl group, or a tolyl group.

2. The electrophotographic photosensitive member according to claim 1, wherein, in the general formula (1), $R^1$ to $R^3$ each represents an alkyl group having 2 to 6 carbon atoms.

3. The electrophotographic photosensitive member according to claim 1, wherein the metal oxide particle comprises a zinc oxide, a titanium oxide, an aluminum oxide, or a tin oxide.

4. A process cartridge which integrally holds the electrophotographic photosensitive member according to claim 1 and at least one unit selected from the group consisting of a charging unit, a developing unit, a transferring unit, and a cleaning unit, and which is detachably mountable to a main body of an electrophotographic apparatus.

5. An electrophotographic apparatus comprising:

the electrophotographic photosensitive member according to claim 1;

a charging unit;

an exposing unit;

a developing unit; and a transferring unit.

6. A method of producing an electrophotographic photosensitive member comprising a conductive support, an undercoat layer formed on the conductive support, and a photosensitive layer formed on the undercoat layer, the method comprising:

a step of forming the undercoat layer using an undercoat layer coating liquid comprising an organic resin, a metal oxide particle, and a compound represented by the general formula (1):

[Chem. 2]

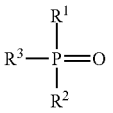

(1)

wherein, in the general formula (1), $R^1$ to $R^3$ each independently represents an alkyl group having 1 to 8 carbon atoms, a phenyl group, or a tolyl group.

7. The method of producing an electrophotographic photosensitive member according to claim 6, wherein, in the general formula (1), $R^1$ to $R^3$ each represents an alkyl group having 2 to 6 carbon atoms.

8. The method of producing an electrophotographic photosensitive member according to claim 6, wherein the metal oxide particle comprises a zinc oxide, a titanium oxide, an aluminum oxide, or a tin oxide.

* * * * *